US006585833B1

(12) United States Patent
Ordillas

(10) Patent No.: US 6,585,833 B1
(45) Date of Patent: Jul. 1, 2003

(54) CRIMPABLE ELECTRICAL CONNECTOR

(75) Inventor: Melrex A. Ordillas, Cleveland Heights, OH (US)

(73) Assignee: Brush Wellman, Inc., Cleveland, OH (US)

( * ) Notice: Subject to any disclaimer, the term of this patent is extended or adjusted under 35 U.S.C. 154(b) by 0 days.

(21) Appl. No.: 09/525,630

(22) Filed: Mar. 14, 2000

(51) Int. Cl.[7] ..... C22C 9/00

(52) U.S. Cl. ..... 148/432; 148/435; 439/843; 439/851

(58) Field of Search ..... 148/432, 435; 439/843, 851

(56) References Cited

U.S. PATENT DOCUMENTS

| | | | | |
|---|---|---|---|---|
| 4,179,314 A | | 12/1979 | Wikle | |
| 4,551,187 A | | 11/1985 | Church et al. | |
| 4,565,586 A | * | 1/1986 | Church et al. | |
| 4,594,116 A | | 6/1986 | Inagaki | |
| 4,599,120 A | | 7/1986 | Church et al. | |
| 4,657,601 A | | 4/1987 | Guha | |
| 4,832,756 A | | 5/1989 | Woodard et al. | |
| 5,147,230 A | * | 9/1992 | Plyler et al. | 439/843 |
| 5,533,916 A | | 7/1996 | Newman et al. | |
| 6,001,196 A | | 12/1999 | Harkness et al. | |

FOREIGN PATENT DOCUMENTS

| | | | |
|---|---|---|---|
| JP | 63026320 | * | 2/1988 |
| JP | 01168831 | * | 7/1989 |
| JP | 04136142 | * | 5/1992 |
| JP | 04221031 | * | 8/1992 |
| JP | 04231430 | * | 8/1992 |
| JP | 11061295 | * | 3/1999 |

OTHER PUBLICATIONS

Harkness et al., "Beryllium–Copper and Other Beryllium–Containing Alloys," *Metals Handbook*, vol. 2, 10th Ed., 1993.

* cited by examiner

*Primary Examiner*—Sikyin Ip
(74) *Attorney, Agent, or Firm*—Calfee, Halter & Griswold, LLP

(57) ABSTRACT

An electrical connector made from a Be-Cu alloy can be crimped at room temperature without localized annealing of the crimp section first. Sufficient ductility and tensile strength are imparted to the alloy by cold working the alloy, after final solution annealing, by at least 40% in terms of area reduction and then overaging the alloy during age hardening.

13 Claims, 2 Drawing Sheets

Crimpability vs. Tensile Properties and Heat Treatment

Figure3 : Crimpability vs. Tensile Properties and Heat Treatment
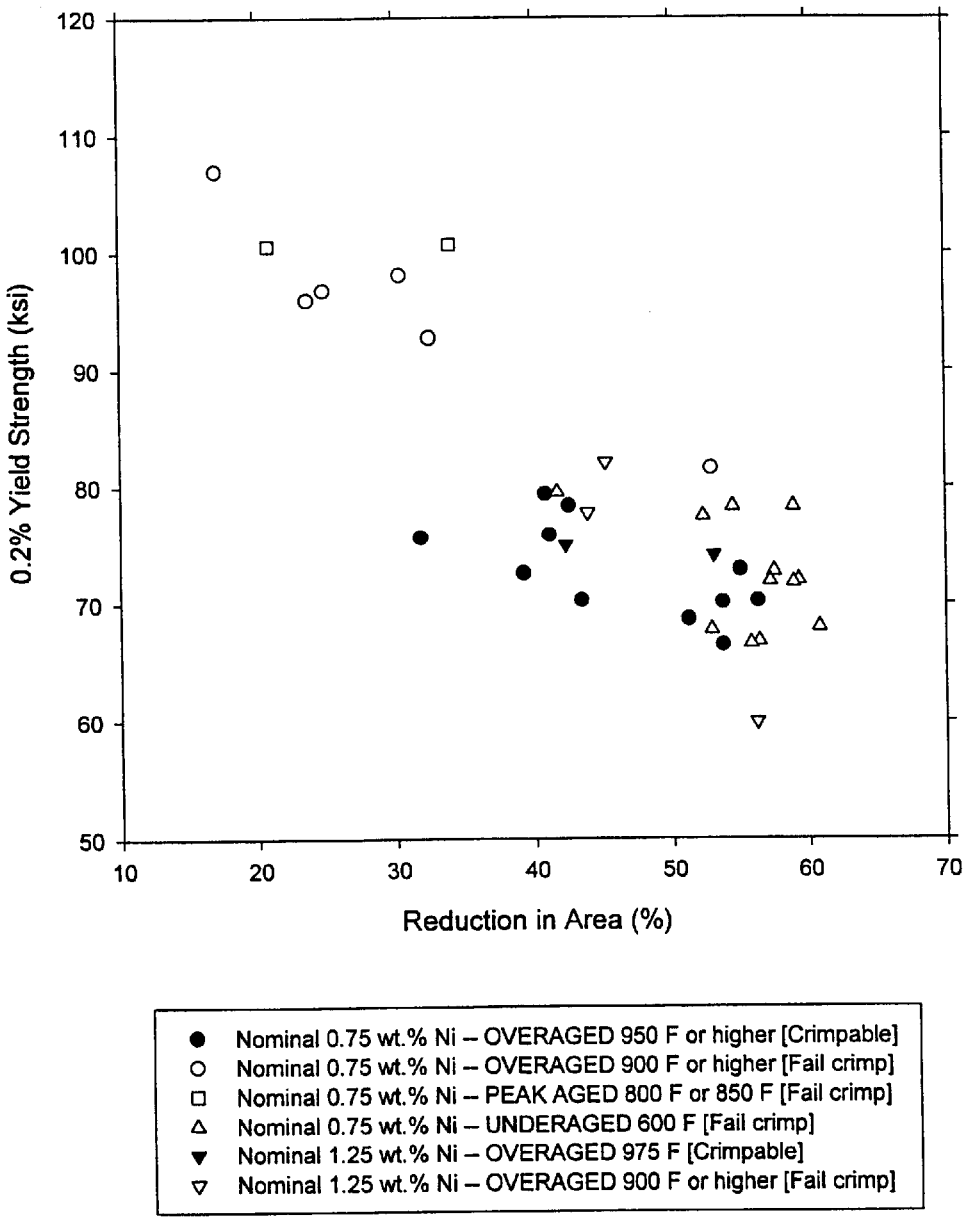

CRIMPABLE ELECTRICAL CONNECTOR

BACKGROUND OF THE INVENTION

1. Field of the Invention

The present invention relates to an improved, crimpable electrical connector and to a copper-beryllium alloy particularly suited for making this electrical connector.

2. Background

Many different crimpable electrical connectors have been developed for connecting electrical wires and other electrical contacts together. One such conventional, crimpable, "female" electrical connector 10 is shown in FIGS. 1 and 2, with FIG. 1 illustrating the connector prior to crimping and FIG. 2 illustrating the connector after crimping. In typical practice, multiple female connectors 10 are mounted in a terminal block or other device for connection to multiple "male" connectors of complementary design.

As illustrated in the figures, female connector 10 includes a spring section 14 defined by a socket 16 for releasably receiving the corresponding protrusion of a complementary male connector. In addition, female connector 10 also includes a crimp section 16 for permanently attaching the connector to a wire by crimping. In the particular embodiment shown, crimp section 16 is formed by crimp barrel 20, which comprises a hollow, cylindrical section which can be crimped to securely fasten the end of a wire inserted therein.

In order that a crimpable electrical connector such as illustrated in FIGS. 1 and 2 can work properly, it must exhibit a particular combination of properties. First, spring section 14 must exhibit adequate yield strength to resist permanent set on mating with its complementary connector. This is necessary in order that spring section 14 exerts sufficient spring force to securely hold the complementary male connector in place even though the female and male connectors are repeatedly joined, separated and rejoined. Second, crimp section 16 must exhibit sufficient ductility to allow crack-free crimping. If cracks form in the crimp section on crimping, the crimped connection will fail making the connector useless.

In manufacturing connectors of the type illustrated in FIGS. 1 and 2, a high-speed automatic forming machine severs a continuous wire of desired final diameter into sections and then cold forges (cold heads) and/or machines the wire sections into desired shapes. The shaped sections are then heat-treated to enhance strength and/or hardness through precipitation hardening of the alloy forming the wire, thereby producing the final connector product.

In this connection, electrical connectors such as illustrated in FIGS. 1 and 2 are usually made from copper alloys such as C19150 or C19160 both comprising nominal 1% Ni, 0.2% P, balance Cu, with, respectively, 0.5% or 1% Pb. Such alloys are typically manufactured by a process terminating in steps of (a) cold drawing the rod to a ready to finish anneal diameter, (b) solution annealing the cold drawn rod and (c) cold drawing the solution annealed rod to final diameter. Such alloys, at final diameter, can be shaped by the connector manufacturer while still relatively soft and then be hardened and strengthened by heat treatment. Alloys of this type are used because they exhibit suitable combinations of electrical conductivity, resiliency and tensile strength.

Unfortunately, heat treated alloys of this type have comparatively poor room temperature ductilities. As a result, connectors made from such heat hardened alloys must be locally softened before they can be attached to wires by crimping or similar operations, since they will crack or break if crimping is attempted without softening. Commercially, softening is typically done by locally reheating crimp section 16 of the connector by laser, electron beam, induction, or other spot heating methodology, immediately before crimping, to anneal the crimp region while retaining full heat treated strength in spring section 14. This localized annealing step is inherently expensive and contributes significantly to the cost of using electrical connectors of this design.

Accordingly, it is an object of the present invention to provide new electrical connectors of the type illustrated in FIGS. 1 and 2, which exhibit essentially the same strength, resiliency and electrical conductivity as conventional connectors, but which also exhibit sufficient room temperature ductility so that they can be attached to wires by crimping without localized heat softening as necessary in prior art designs.

SUMMARY OF THE INVENTION

This and other objects are accomplished by the present invention which is based on the discovery that certain copper-beryllium alloys, if cold worked and heat treated in a particular manner after final solution annealing, exhibit yield strengths high enough for use as electrical connectors and yet sufficient ductilities to allow crimping without reheating for localized annealing and softening.

In particular, the present invention is based on the discovery that a copper-beryllium alloy comprising 0.15 to 0.5 wt. % Be, 0.4 to 1.40 wt. % Ni or Co or both and 0.2 to 1.0 wt. % Pb—if age-hardening to a 0.2% yield strength between about 60 and 80 ksi for achieving resistance to permanent set upon mating—will also exhibit sufficient ductility to allow crack-free crimping without localized reheating provided that the alloy is cold worked after final solution annealing by about 40 to 80% and further provided that age hardening is carried out by over-aging.

Thus, the present invention provides a new electrical device having a spring end capable of maintaining a desired spring normal force after repeated matings and a crimp section capable of being joined to a wire or other component by crack-free crimping without localized annealing of the crimp region before crimping, the device being formed from an alloy comprising 0.15 to 0.5 wt. % Be, 0.4 to 1.40 wt. % Ni or Co or both, and 0.2 to 1.0 wt. % Pb, the balance being copper and incidental impurities, wherein the device after final solution annealing is cold worked by 40 to 80% and is overaged during age-hardening so that the alloy forming the device achieves a final 0.2% yield strength between about 60 and 80 ksi. When so treated, the alloy forming the device will also typically have a ductility between about 20 and 65%, measured in terms of area reduction, more typically between about 30 and 65%.

Preferably, the alloy forming the electrical connector is overaged during age hardening so that the tensile strength of the alloy is less than about 90% of its maximum tensile strength when age peak aged. Moreover, final solution annealing of the alloy is desirably done at temperatures no higher than about 1650° F.

In one particular embodiment of the invention, the alloy forming the connector has a minimum 0.2% yield strength of 70 ksi and a ductility of about 30%. In another particular embodiment, the alloy forming the connector has a minimum 0.2% yield strength of 65 ksi and a ductility of about 50%.

In addition to electrical connectors, the present invention also provides wire stock and bar stock useful for forming these connectors. In one embodiment, it is contemplated that this stock will be "finished to size" and age hardened by the mill before being transferred to the fabricator, with the connector fabricator simply cutting the stock to sections of appropriate length and then machining the sections into the desired shape. In this embodiment, the present invention provides wire or bar stock in the form of a continuous wire or bar, the stock being formed from an alloy comprising 0.15 to 0.5 wt. % Be, 0.4 to 1.40 wt. % Ni or Co or both, and 0.2 to 1.0 wt. % Pb, the balance being copper and incidental impurities, the alloy having been cold worked after final solution annealing by 40% to 80% and overaged during age-hardening to achieve a final 0.2% yield strength between about 60 and 80 ksi and a ductility between about 30 and 65%.

In another embodiment, it is contemplated that the mill will provide the fabricator with stock already worked to "finished size" but not final age hardened. In this embodiment, it is contemplated the connector fabricator will cut the stock to sections of appropriate length, fabricate the sections into final shape by one or more shaping steps including working and machining, and finally heat treat the fabricated sections by overaging in accordance with the present invention to achieve the desired combination of 0.2% yield strength and ductility. In this embodiment, the present invention provides wire or bar stock in the form of a continuous wire or bar, the stock being formed from an alloy comprising 0.15 to 0.5 wt. % Be, 0.4 to 1.40 wt. % Ni or Co or both, and 0.2 to 1.0 wt. % Pb, the balance being copper and incidental impurities, the alloy having been cold worked after final solution annealing by greater than 40% to 80%.

Finally, the present invention also provides a new Be-Cu alloy comprising 0.15 to 0.5 wt. % Be, 0.4 to 1.40 wt. % Ni or Co, or both, and 0.2 to 1.0 wt. % Pb, the balance being copper and incidental impurities, the alloy having been cold worked after final solution annealing by 40 to 80% and overaged during age-hardening to achieve a final 0.2% yield strength between about 60 and 80 ksi and a ductility between about 20 and 65%, more typically 30 to 65%.

BRIEF DESCRIPTION OF THE DRAWINGS

The present invention may be more readily understood by reference to the following drawings wherein:

FIG. 3 is a graph illustrating the trade-off between crimpability and strength in alloys made in accordance with the present invention, as a function of final age-hardening conditions, when fabricated into electrical connectors made in accordance with the present invention.

DETAILED DESCRIPTION

Figure 1:
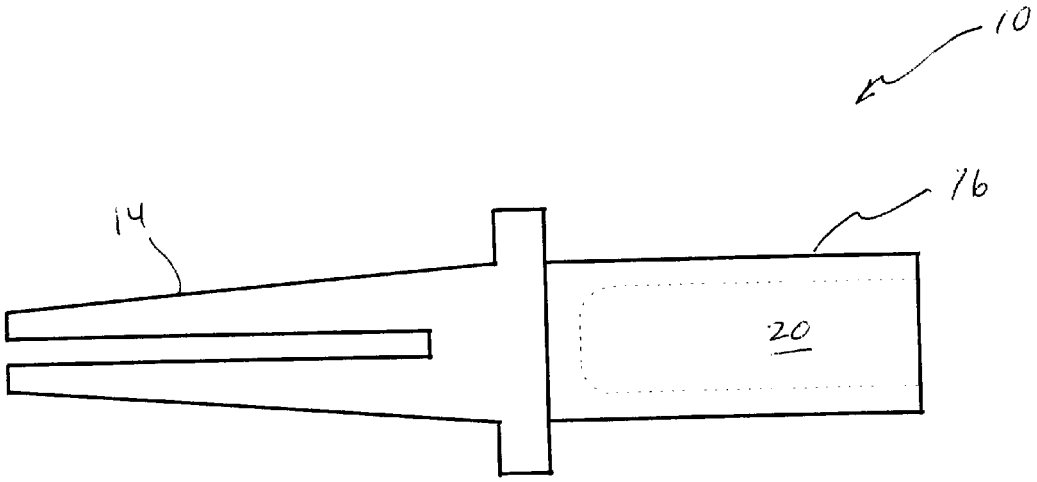
FIGS. 1 and 2 illustrate the structure of electrical connectors suitable for manufacture in accordance with the present invention.

In accordance with the present invention, the prior art practice of locally annealing the crimp sections of electrical connectors which are both crimpable and spring actuated is avoided by forming the connectors from a particular class of beryllium-copper alloys.

Be-Cu Alloys

Be-Cu alloys constitute a well-known class of commercially-available alloys known for their excellent physical and electrical properties, especially tensile strength and electrical conductivity. See, Harkness, et al., "Beryllium-Copper and Other Beryllium-Containing Alloys", Metals Handbook, Vol. 2, 10th Ed., ©1993 ASM Int'l. The excellent physical properties of these alloys arise through a precipitation-hardening mechanism in which numerous, very small beryllide particles form in the copper matrix and generate coherency strains to strengthen the alloy.

Forming useful products from Be-Cu alloys derived from an ingot ("as-cast Be-Cu alloys") typically involves a series of heating and working steps to impart the desired shape, grain structure and properties to the alloy. These steps in the aggregate can be considered as constituting:

(a) a shaping regimen for changing the bulk shape of the alloy as derived from the ingot into a shape approaching the final desired shape of the product and also for imparting a finer, more nearly uniform or homogeneous wrought grain structure to the alloy, and (b) a hardening regimen for nucleating and growing the beryllium-rich precipitates responsible for hardening.

Commercially, the shaping regimen involves one or more working steps and solution heat treatment (annealing) steps. Working can be done either at elevated temperatures ("hot working") or at lower temperatures such as room temperature ("cold working"). Hot working of wire is commonly done by extrusion, which converts a coarse, compositionally non-uniform cast structure into a more homogeneous wrought structure. Cold working of wire is typically done by cold drawing. Annealing is typically done by heating the alloy at about 1500–1800° F. (815–982° C.) for about 5 minutes to about 1 hour, followed by rapid quenching. Annealing recrystallizes a severely deformed cold worked structure and dissolves a maximum amount of beryllium and other components that might be present, retaining them in metastable solid solution preparatory to precipitation hardening. Internal stresses in the alloy are also reduced. Both cold working and annealing may be done multiple times, especially if change in shape is large. A final solution anneal is imparted at a ready-to-finish size. Thereafter the alloy is optionally cold worked a defined amount to a finished size.

Precipitation hardening ("age hardening") of Cu-Be alloys is typically done by heating the alloy at about 500–1050° F. (260–565° C.) for a time sufficient to develop maximum hardness in the alloy, typically between about 5 minutes to about 6 hours. In general, each Be-Cu alloy, solution annealed at a particular temperature and optionally cold worked a particular amount to final size, has its own particular time/temperature combination leading to maximum hardness, meaning that if the alloy is heated either too little or too much its hardness and other properties are less than optimal. Thus, it is conventional to refer to such alloys as being "peak aged" if age hardened at or near optimal time/temperature conditions, or as "underaged" or "overaged" if heated too little or too much. Viewed another way, underaged Cu-Be alloys have the potential to increase in hardness if heated further, whereas overaged Cu-Be alloys will only soften more on further heating.

Commercially, age hardening can be accomplished in multiple steps, if desired, although care is normally taken to avoid overaging. Also, age hardening is usually but not always carried out after the final product shape is imparted to the alloy, since it is easier to work the alloy while it is softer rather than harder.

Be-Cu alloys exhibit the property in that cold working before age hardening increases both the rate and magnitude of the age-hardening response, at least up to a certain maximum hardness level inherent for each alloy. Therefore, hardening in commercial practice typically involves cold working after final solution annealing and before age hardening in an amount of up to about 90% in terms of area reduction, i.e. a reduction in a cross-sectional area of the workpiece by up to about 90% as a result of the cold working operation.

Chemistry of the Inventive Be-Cu Alloys

In accordance with the present invention, a particular class of Be-Cu alloys is employed, these alloys containing the following components:

TABLE I

| Alloy Components, wt. % | | | |
|---|---|---|---|
| Component | Operable | Typical | More Typical |
| Be | 0.15 to 0.50 | 0.20 to 0.40 | 0.25 to 0.35 |
| Ni &/or Co | 0.40 to 1.40 | 0.50 to 1.25 | 0.60 to 0.80 |
| Pb | 0.20 to 1.00 | 0.20 to 0.60 | 0.25 to 0.50 |
| Cu | Balance | Balance | Balance |

In addition to the above named components, the alloys used in the present invention can contain up to a total of 0.50 wt. % of one or more of the following ingredients, typically as impurities: iron, aluminum, silicon, chromium, zinc, tin, silver, manganese, magnesium, titanium and zirconium. Also, nickel is more common than cobalt in these alloys, although combinations of nickel and cobalt are typical.

The alloys used in the present invention are "lean" Be-Cu alloys. By "lean" is meant that these alloys contain no more than about 0.50 wt. %, preferably no more than about 0.40 wt. %, beryllium and no more than about 1.40 wt. %, preferably no more than about 1.25 wt. %, nickel and cobalt, or both. If the alloys contain more than about 0.50 wt. % beryllium, then strength will be greater than necessary, ductility will be less than required, electrical conductivity will be insufficient and the cost of the alloy will be unnecessarily increased, given the high cost of beryllium as an alloying element. Similarly, if the alloys of the present invention contain more than 1.40 wt. % nickel plus cobalt, then excessive strength, insufficient ductility and reduced electrical conductivity will be exhibited.

Lead is added to the alloys of this invention for improved machinability. If the amount of lead is insufficient, typically less than about 0.2 wt. %, the chips generated by machining steps performed during parts-making operations are long, stringy and hard to eject from the tool-workpiece interface—a circumstance which can cause catastrophic tool breakage or accelerated tool wear. In the presence of sufficient lead, machining chips inherently break into short lengths which can be easily ejected to avoid tool breakage or excessive wear. If lead exceeds about 1.00 wt %, preferably 0.60 wt %, then the alloys are prone to cracking or "hot tearing" during hot working of the alloy from the cast ingot to wire by, e.g., extrusion.

Processing of Inventive Be-Cu Alloys

Lean Be-Cu alloys are known in the art and described, for example, in U.S. Pat. No. 4,179,314 to Wikle, U.S. Pat. No. 4,551,187 to Church, et al., U.S. Pat. No. 4,599,120 to Church, et al and commonly assigned application Ser. No. 08/738,880, the disclosures of which are incorporated herein by reference. Each of these patents describes Be-Cu alloys prepared by annealing and cold working, optionally carried out twice, followed by age-hardening. However, in the above-noted Wikle patent, cold working after final solution annealing is no more than 30–40%, while in the other patents noted above, age-hardening is normally conducted at peak aging conditions.

The present invention departs from these patents in that the alloys are cold worked after final solution annealing by greater amounts than typically done in the past, i.e., by about 40 to 80% in terms of area reduction, and then overaged in the final age hardening step. As a result of this approach, the alloys obtained exhibit a unique combination of yield strengths and ductilities, allowing them to resist permanent set upon mating, as in the case of prior art connectors, but also allowing them to be crimped without cracking, even though the crimpable sections thereof have not been reheated for achieving localized annealing as in the case of prior art practice.

This advantageous result is more clearly illustrated in FIG. 3 herein which graphically illustrated the results obtained in working Examples 1 to 38 herein in which electrical connectors made in general accordance with the present invention were tested for 02.% Yield Strength, ductility (% Reduction in Area) and crimpability. In all of these examples, the electrical connectors were made from alloys of the desired chemistry which were cold worked between 40 and 80% after final solution anneal. As shown in FIG. 3, these alloys uniformly exhibited 0.2% Yield Strengths of about 60 ksi or more and ductilities of 20 to 65%, more typically 30 to 65%, regardless of age hardening history. However, only those alloys which had yield strengths between about 60 and 80 ksi, and which also had been overaged during age hardening, crimped at room temperature without cracking. The other alloys—that is the alloys which had been underaged, peak aged, or age hardened to above 80 ksi—did not crimp without cracking, even though these alloys were otherwise the same in terms of chemistry, annealing history and cold work history.

Processing of the Be-Cu alloys used to form the inventive electrical connectors can be done in essentially the same way as conventional prior art processes. However, cold working after final solution anneal (exclusive of any additional cold work imparted by the cold forming or cold heading done for shaping the connector) should be limited to about 40 to 80% in terms of area reduction, with cold working of about 50 to 70%, and even about 60%, being more typical. If cold working is less than about 40%, mechanically working the wire into suitable shape such as by cold heading, for example, becomes difficult and overaging strength may be inadequate. If cold working is more than about 80%, the rate of overaging is very rapid, which risks dropping yield strength below minimum acceptable values for desired spring performance and ductility. Crimpability may also be inadequate.

Incidentally, it should also be appreciated that the cold working described in the above paragraph is exclusive of any additional cold working that may be involved in final shaping of the alloy into an electrical connector such as, for example, by cold heading or cold forming.

As for age hardening, essentially any conditions can be used which will achieve overaging of the alloys as described above. For example, age hardening can be conveniently carried out at temperatures from about 900° F. to 1000° F. (480° C. to 540° C.), more typically 950° F. to 975° F. (515° C. to 525° C.), for 3 hours to 9 hours, more typically 5 hours to 7 hours, with higher temperatures being associated with shorter processing times and conversely. Preferably, overaging is accomplished in a manner such that the alloy has a tensile strength of no more than 95% of its maximum tensile strength achieved upon peak aging, more typically no more than about than 90% of its maximum tensile strength achieved upon peak aging.

In this connection, it should also be appreciated that overaged Be-Cu alloys of the present invention typically exhibit an electrical conductivity of at least about 50% IACS, more typically 60% IACS or more, and further that this electrical conductivity is normally higher than the electrical conductivities of alloys of the same chemical composition which are peak aged or under aged. For example, Alloy B of Table II below when underaged at 600° F. for 3 hours to 5 hours exhibits an electrical conductivity of no more than about 48% IACS, but when overaged at 1000° F. for 7 hours exhibits an electrical conductivity of about 64% IACS. Similarly, Alloy A when underaged at 600° F. for 3 hours to 5 hours exhibits an electrical conductivity of no more than about 42% IACS, while Alloy D when overaged at 950° F. for 5 hours exhibits an electrical conductivity of about 71% IACS. Accordingly, in addition to using the traditional method of distinguishing between underaged, peak aged and overaged Be-Cu alloys as discussed above, the electrical conductivities of these alloys can also be used as a measure of their age hardening condition.

It should also be appreciated that overaging will usually be done in accordance with the present invention after the workpiece is cold formed and/or machined into final shape. However, overaging can occur before final shaping, if desired. Moreover, age hardening can be done in steps, if desired, with one or more preliminary age hardening steps being done at underaging or peak aging conditions, followed by final age hardening at overaging conditions. For example, the work piece can be treated at 800° F. to 900° F. (430° C. to 480° C.) for about 5 hours followed by a second age hardening heat treatment at 900° F. to 1000° F. (480° C. to 540° C.), more typically 950° F. to 975° F. (515° C. to 525° C.), for about 5 hours. If desired, machining of the workpiece into final shape can be interposed between the first and second age hardening steps. For example, a wire section or rod in finished diameter can be underaged or peak aged after cold heading or other mechanical working operation but before final machining and then overaged in accordance with the present invention after final machining but before crimping.

Finally, it is also desirable although not required to maintain the final anneal temperature of the workpiece at the lower portion of the normal anneal temperature range of 1500–1800° F. (815–982° C.). Temperatures below about 1650° F. are desirable, while temperatures of about 1550° F. are more typical.

Tensile Strength versus Ductility

As shown in FIG. 3, 0.2% yield strength and ductility (as measured by Reduction in Area) bear an essentially inverse relationship with one another in Be-Cu alloys of the type in interest in the present invention. Therefore, when the present invention is adapted to a particular application, care should be taken to select a particular alloy which has a combination of 0.2% yield strength and ductility appropriate for that application.

That is to say, the operating characteristics of a particular electrical connector in terms of the spring force exerted at its spring end and crimpability exhibited at its spring end depend not only on the properties of the alloy forming the connector but also on the geometry of the connector itself. Therefore, when adapting the present invention to a particular application, the processing parameters selected to produce the alloy (i.e., chemistry, solution annealing temperature, cold work, and overaging temperature and time) should be selected such that the resultant yield strength of the alloy is greater than a predetermined minimum determined by the shape and anticipated deflection at the spring end of the connector but below a maximum strength above which ductility at the crimp end of the connector is insufficient to prevent cracking.

In other words, since the ductility of an alloy is related to its strength, the alloy chosen for a particular design cannot be too strong since its ductility would be insufficient to prevent cracking at its crimp end if made without localized annealing. Therefore, when choosing the alloy to use for a particular application (including both its chemistry and processing conditions as described above) care must be taken to select an alloy whose yield strength is above a minimum value required for adequate spring performance at the connector's spring end but below a maximum which would lead to insufficient ductility at the connector's crimp end.

Determining the minimum acceptable yield strength for an alloy to be used in a particular connector design can be done in a conventional manner in the same way as currently done for existing connector designs. Determining the maximum alloy yield strength can then be accomplished, in accordance with the present invention, by developing a plot such as illustrated in FIG. 3 for that design. In particular, a plot like that of FIG. 3 which is specific to the particular connector design contemplated will identify the permissible range of yield strengths and ductilities (measure in % area reduction) that are possible for that design. In addition, the data developed in generating this plot will also identify particular combinations of alloy parameters (chemistry and conditions of solution annealing, cold work and overaging) needed to achieve particular combinations of these properties. Within these constraints, a particular combination of alloy manufacturing parameters can be selected to achieve an optimal combination of yield strength and ductility for that design.

In this connection, it is contemplated that the present invention will be broadly applicable to designing electrical connectors in two different situations, Case A and Case B, as follows:

CASE A—The connector design already exists and employs a more expensive alloy or relies on a more expensive alloy/process combination to fabricate the connector. Alloys of the present invention are to be directly substituted for the alloys currently used in the existing design, primarily for cost reduction. Cost reduction comes from the combination of differences in base costs of alloys specified and the added cost of a "zone anneal" in the non-inventive alloy (eliminated in the alloys of this invention). The user will not modify spring geometry nor crimp section geometry. The approach in applying the present invention, in this case is then to select the alloy and the processing thereof (Ni content, ready-to-finish anneal temperature, cold work to final size, and final age hardening conditions) to generate a yield strength falling between two limits—a lower YS below which spring force is inadequate in the spring end of the existing connector design (more than likely matching the minimum YS of the competitive alloy to be displaced from the existing design) and some maximum YS above which ductility is inadequate to survive crimping without cracking in the spring end of the existing connector. The latter YS limit is unique to the present invention and irrelevant to prior art alloys which must be zone annealed at their crimp ends. Final age hardening treatment may be applied (1) after the connectors are fabricated but before crimping in the case of "cold headed" and aged connectors or (2) before any connector fabrication and subsequent crimping in the case of connectors machined from pre-aged solid wire or rod.

CASE B—The design is "new" and is intended to create a new connector that leverages the advantages of the alloys and process of the present invention to enable cost reduction and/or connector performance improvement over connectors of the prior art. Here, a more traditional design engineering approach applies:

(1) Establish size limitations on the connector designs which is dictated by space allocated for interconnects in a larger electrical or electronic assembly, e.g., on or between printed circuit boards or mating devices.

(2) Define performance requirements of the connector in terms of (a) minimum normal force to maintain circuit integrity under intended conditions of use—maximum permissible deflection of spring in space allotted, necessary resistance to vibration/shock (mechanical overloads), elevated temperature (stress relaxation); etc.; (b) maximum insertion force which must not be exceeded to permit ease of connecting multiple contacts at once; (c) minimum electrical conductivity to handle the expected electrical amperage/power without excessive temperature rise; (d) minimum ductility to permit connector fabrication—ability to form bends of a particular severity (bend radius over spring beam thickness, R/t) in spring beams or to survive crimp terminations of a particular severity (Note—crimp severity will be driven by the design of the crimp as dictated by lead wire size vs. hole size, required "pull strength" to resist loss of signal integrity in crimp due to vibration, assembly forces, long time thermal exposure, etc.); and (e) competitive marketplace-imposed cost constraints (alloy & process selection).

(3) Using routinely available classical mechanical spring design equations or finite element computer models based on classical mechanical equations, establish the minimum yield strength to impart the minimum room temperature normal force for the design-dictated spring beam cross-sectional dimensions and deflection. Select a "short list" of alloys which are capable of attaining this YS minimum and narrow the list further to a single material within the invention by eliminating those competitive alloys with inadequate conductivity, temperature resistance, and/or ductility and those with higher cost.

For example, in designing the electrical connectors of the following working Examples 1 to 38 (which were identical in terms of size and shape) the particular geometry and size of the spring end dictated that the alloy forming this part of the connector have a minimum yield strength of 70 to 75 ksi to assure adequate spring performance. From the data of FIG. 3, it was then determined that the crimp section of the connector, because of its particular design, needed to be formed from an alloy having a minimum ductility of about 30% in terms of area reduction to prevent cracking upon crimping. FIG. 3 further indicated that the maximum yield strength in the spring end, after overaging, should not exceed about 80 to perhaps 85 ksi to assure that ductility not fall below about 30%.

In the same way the connectors of working Examples 39 to 41 were made with a different and less demanding design criterion which allowed the alloy in the spring section to have a minimum yield strength of only about 65 ksi. As discussed below, these connectors were formed by cold heading of wire which had been mill overaged to final strength and received no additional heat treatment after forming. From Table IV below, the crimp section geometry was such that the spring end (i.e. the mill aged wire base material) yield strength could range as high as 82 ksi and adequate ductility would be retained for crimping without cracking.

It will therefore be appreciated that, because of the trade off between ductility and yield strength illustrated in FIG. 3, no one combination of yield strengths and ductilities is appropriate for all connectors made in accordance with the present invention. Nonetheless, connectors with widely varying spring properties and crimpability can be achieved in accordance with the present invention, without the localized annealing necessary in prior art processes, by suitable selection of the alloy used to form the connector in keeping with its desired operating properties and design.

The present invention, therefore, contemplates new electrical connectors formed from Be-Cu alloys, having a combination of properties not available in the past. In addition, the present invention further contemplates a new process for manufacturing such alloys in which cold working and age-hardening after final solution annealing are done under different conditions than carried out in the past. Furthermore, the present invention also contemplates new wire and bar stock products not previously known.

EXAMPLES

In order to more thoroughly illustrate the present invention, the following working examples were conducted. In these working examples, a series of alloys was prepared, these alloys having the chemical compositions set forth in the following Table II:

TABLE II

| | Alloy Components, wt % | | | | | |
|---|---|---|---|---|---|---|
| Alloy | Be | Ni | Sn | Zr | Pb | Cu |
| A | 0.32 | 0.79 | <0.005 | 0.022 | 0.56* | Balance |
| B | 0.24 | 0.75 | 0.022 | 0.21 | 0.51* | Balance |
| C | 0.25 | 1.28 | <0.005 | 0.18 | 0.53* | Balance |
| D | 0.29 | 1.26 | <0.005 | 0.23 | 0.32* | Balance |
| E | 0.27 | 1.24 | <0.005 | 0.22 | 0.30* | Balance |
| F | 0.26 | 0.79 | <0.005 | 0.17 | <0.003 | Balance |

*Alloys A through E containing 0.30% to 0.56% Pb exhibited desirable short, broken chips upon machining whereas the comparative Alloy F with only a trace amount of Pb machined with undesirable long, stringy chips

Examples 1 to 38

Figure 2:
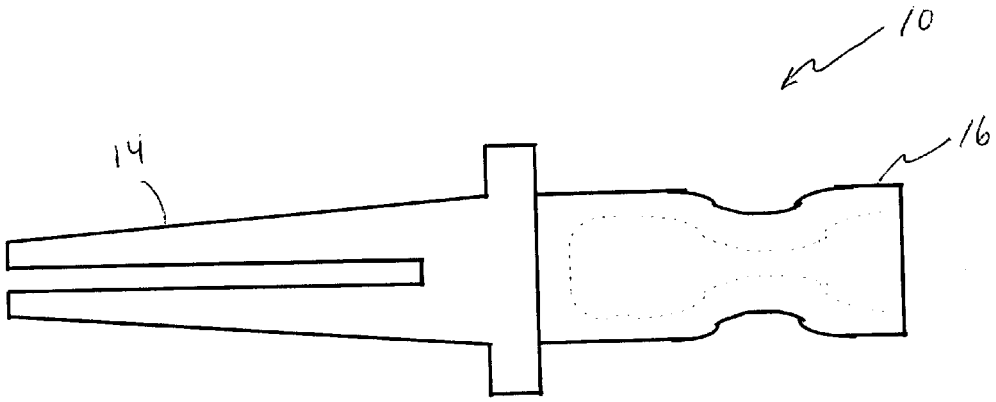

Electrical connectors, as illustrated in FIGS. 1 and 2, were produced using the above Alloys A through F. The design criteria for these connectors called for a final diameter of 0.097 inch and a 0.2% yield strength of 70 to 75 ksi minimum to assure adequate spring force. In each case, the alloy was cast as a nominal 2 in. or 6 in. diameter ingot. The ingots were hot extruded and cold drawn to wire with an optional intermediate solution annealing at 1700° F. (930° C.) being performed on the wires produced from the 6 in. diameter ingots. The wires so formed were then solution annealed at a ready to finish diameter and then cold drawn by various amounts to a final diameter of 0.097 in.

The wires so formed were then subdivided into segments and the segments cold headed to form cylindrical openings in both ends of the wire. One end of each male connector was then machined to form slots for a collet-shaped spring element as illustrated in FIGS. 1 and 2. Thereafter, the so machined parts were age-hardened. After age-hardening, the other cold headed end of each part was attached to a lead wire by crimping at room temperature. The crimps so formed were then inspected for cracks.

Some of the cold headed parts of these examples tended to "flare" during pre-age machining, either from residual stresses, or deformation from cutting forces due to low strengths. Therefore, in Examples 13-A through 15-A and 35-E through 38-E, age-hardening was carried out in two steps with the first step being carried out before machining and the second step being carried out after machining but before crimping.

The results obtained are set forth in the following Table III. For convenience, those parameters responsible for a particular connector failing to achieve crimping without cracking are italicized and emboldened.

TABLE III

Properties of Electrical Connectors of Examples 1 to 38

| Example No. & Alloy | RF Anneal (F) | Cold Work (%) | Aging Treatment | 0.2% YS (ksi) | UTS (ksi) | % Area Reduction | Crimp Without Cracks? |
|---|---|---|---|---|---|---|---|
| 1-A | 1550 | 40 | 950 F/2 hr | **81.6** | 96.5 | 52.9 | NO |
| 2-A | 1550 | 40 | 950 F/3 hr | 79.4 | 97.2 | 40.8 | YES |
| 3-A | 1550 | 40 | 950 F/5 hr | 72.6 | 90.8 | 39.2 | YES |
| 4-A | 1550 | 40 | 950 F/7 hr | 70.3 | 90.1 | 43.4 | YES |
| 5-A | 1550 | 40 | 975 F/3 hr | 72.9 | 87.9 | 55.0 | YES |
| 6-A | 1550 | 40 | 975 F/5 hr | 70.2 | 82.4 | 56.3 | YES |
| 7-A | 1550 | 40 | 975 F/7 hr | 70.1 | 86.5 | 53.7 | YES |
| 8-A | 1550 | 40 | 975 F/9 hr | 66.5 | 81.1 | 53.7 | YES |
| 9-A | 1550 | 80 | 950 F/3 hr | **107.0** | 115.5 | 17.1 | NO |
| 10-A | 1550 | 80 | 950 F/5 hr | **96.0** | 111.1 | 23.7 | NO |
| 11-A | 1550 | 80 | 950 F/7 hr | **96.8** | 109.0 | 24.9 | NO |
| 12-A | 1550 | 80 | 975 F/5 hr | **98.1** | 110.0 | 30.4 | NO |
| 13-A | 1550 | 40 | 900 F/5 hr + 900 F/3 hr** | 78.4 | 93.2 | 42.5 | YES |
| 14-A | 1550 | 40 | 900 F/5 hr + 950 F/3 hr** | 75.9 | 91.1 | 41.1 | YES |
| 15-A | 1550 | 40 | 900 F/5 hr + 975 F/3 hr** | 75.7 | 87.1 | 31.8 | YES |
| 16-A | 1550 | 80 | 800 F/5 hr | **100.6** | 113.5 | 20.9 | NO |
| 17-A | 1550 | 80 | 800 F/5 hr | **100.7** | 111.4 | 34.0 | NO |
| 18-B | 1550 | 40 | 900 F/5 hr | **92.8** | 102.2 | 32.5 | NO |
| 19-B | 1550 | 80 | 975 F/5 hr | 68.7 | 80.4 | 51.2 | YES |
| 20-B | 1550 | 40 | **600 F/1 hr** | 67.8 | 74.1 | 52.9 | NO |
| 21-B | 1550 | 40 | **600 F/3 hr** | 66.8 | 75.3 | 56.4 | NO |
| 22-B | 1550 | 40 | **600 F/5 hr** | 66.6 | 76.4 | 55.8 | NO |
| 23-B | 1550 | 40 | **600 F/7 hr** | 68.0 | 76.9 | 60.8 | NO |
| 24-B | 1550 | 60 | **600 F/1 hr** | 72.7 | 79.3 | 57.5 | NO |
| 25-B | 1550 | 60 | **600 F/3 hr** | 72.0 | 80.3 | 59.3 | NO |
| 26-B | 1550 | 60 | **600 F/5 hr** | 71.8 | 81.8 | 58.9 | NO |
| 27-B | 1550 | 60 | **600 F/7 hr** | 71.9 | 82.6 | 57.2 | NO |
| 28-B | 1550 | 80 | **600 F/1 hr** | 78.3 | 83.9 | 54.5 | NO |
| 29-B | 1550 | 80 | **600 F/3 hr** | 77.5 | 84.9 | 52.3 | NO |
| 30-B | 1550 | 80 | **600 F/5 hr** | 78.3 | 86.1 | 58.9 | NO |
| 31-B | 1550 | 80 | **600 F/7 hr** | 79.5 | 87.3 | 41.7 | NO |
| 32-C | 1700 | 84 | 950 F/5 hr | 77.8 | 86.7 | 43.9 | NO |
| 33-D | 1700 | 60 | **800 F/3 hr** | **112.9** | 126.1 | No data | NO |
| 34-D | 1700 | 60 | **900 F/5 hr** | **110.5** | 119.1 | No data | NO |
| 35-E | 1550 | 60 | 800 F/5 hr + 950 F/5 hr** | **82.1** | 91.9 | 45.2 | NO |
| 36-E | 1550 | 40 | 800 F/5 hr + 975 F/5 hr** | 74.1 | 85.7 | 53.1 | YES |
| 37-E | 1550 | 60 | 800 F/5 hr + 975 F/5 hr** | 75.0 | 86.9 | 42.3 | YES |
| 38-E | 1550 | **80** | 800 F/5 hr + 975 F/5 hr** | 59.9 | 72.5 | 56.2 | NO |
| **C19150 (Comparison)** | | | User age hardened at about 750 F/3 hr to 5 hr | 70–90 | 85–105 | No data | NO (Requires zone anneal prior to crimp) |

**Two-stage batch heat treatment with 1st age hardening performed after cold heading but prior to machining and 2nd age hardening performed after machining but prior to crimping.

Examples 39 to 41

Electrical connectors having a somewhat different geometry from those of Examples 1 to 38, and a nominal diameter of 0.131 inch rather than 0.097 inch, were prepared from Alloy B of the above Table II. Because of this different size and geometry, the final property requirements of these electrical connectors, both in terms of spring force and crimpability, were less severe than those in the electrical connectors of Examples 1 to 38. For example, the minimum 0.2% yield strength of the alloys forming these connectors was only about 60 ksi to 65 ksi rather than 70 to 75 ksi by virtue of less demanding spring force requirements for the particular spring design. Moreover, the connectors of Examples 39 to 41 were made by a somewhat different process than those of Examples of 1 to 38 in that age hardening (overaging) to final yield strength and ductility was accomplished with the alloy still in coil form rather than by heat treatment after parts fabrication.

Thus, in making these connectors, Alloy B was hot extruded and cold drawn to a ready to finish diameter, solution annealed at 1550 F, then cold drawn 50% to a final diameter of 0.131 inch, age hardened (overaged) in coil form, mechanically straightened, cut into sections of suitable length and machined into cylindrical connectors without cold heading to form a collet-shaped spring element at one end of each connector and a blind hole in the opposite end of each connector for crimp termination.

As in the case of Examples 1 to 38, the connectors of Examples 39 to 41 were also attached to a lead wire by crimping at room temperature without localized annealing of the crimp sections, and the crimps so formed then inspected for cracks. The following results were obtained:

TABLE IV

Properties of Electrical Connectors of Examples 39 to 41

| Example No. & Alloy | RF Anneal (F) | Cold Work (%) | Aging Treatment | 0.2% YS (ksi) | UTS (ksi) | % Area Reduction | Crimp Without Cracks? |
|---|---|---|---|---|---|---|---|
| 39-B | 1550 | 50 | 975 F/5 hr | 79.0 | 94.0 | No data | YES |
| 40-B | 1550 | 50 | 975 F/5 hr | 82.0 | 91.0 | No data | YES |
| 41-B | 1550 | 50 | 1000 F/7 hr | 64.7 | 80.0 | No data | Not tested |
| **C19150 (Comparison)** | | | User age hardened at about 750 F/3 hr to 5 hr | 70–90 | 85–105 | No data | NO (Requires zone anneal prior to crimp) |

As explained above in connection with FIG. 3, the above results show that Be-Cu alloys of the indicated chemistry, when cold worked between 40 and 80%, uniformly exhibit 0.2% Yield Strengths of about 60 ksi or more and ductilities of 20 to 65%, more typically 30 to 65%, regardless of age hardening history. However, only those alloys which have yield strengths between about 60 and 80 ksi, and which also have been overaged during age hardening, crimp at room temperature without cracking. The other alloys—that is the alloys which have been underaged, peak aged or age hardened to above 80 ksi—do not crimp without cracking, even though these alloys are otherwise the same in terms of chemistry, annealing history and cold work history. This enables electrical connectors exhibiting desirable combinations of spring properties and crack-free crimping to be formed from these alloys without need for the localized annealing required in prior art procedures for making such connectors.

In addition, the above results show that although most alloys produced in accordance with the above disclosure will achieve crack-free crimping without annealing and acceptable yield strengths, occasional combinations of processing variables might be too severe to achieve this result. For example, comparison of Examples 9-A through 12-A with Examples 2-A through 8-A as well as Example 19B shows that 80% cold working is too severe for Alloy A but not for Alloy B. Similarly, Examples 36 to 38-E show that 80% cold working is too severe for Alloy E. In these instances, cold work should be confined to lower levels of about 75% or 70% or 60% or less. Thus, in some embodiments of the present invention, coldworking is done by 45 to 75%, or even 50 to 70%, most typically about 60%.

This merely illustrates that care must be taken to select appropriate values for each parameter used to carry out specific embodiments of the present invention in order to achieve the desired result of crimpability without cracking at acceptable yield strength. This is no different from any other area of metallurgy where appropriate combinations of parameters must normally be selected to achieve the results desired. Those skilled in the art understand that general discussions of relevant parameters are guidelines, not guarantees, and that routine experimentation may be necessary to apply an invention in its various different embodiments. Based on the above discussion, including working examples, those skilled in the art should have no difficulty in applying the present invention throughout its scope.

Finally, it is also believed that impurity elements may also play a role in achieving products exhibiting the desired property of crimpability without cracking. Thus, zirconium or titanium, which have been shown in commonly assigned application Ser. No. 08/738,880 (the disclosure of which is also incorporated by reference) to enhance thermal stability of "lean" Be-Ni-Cu alloys, tend to retard the overaging precipitation hardening reaction. If either zirconium or titanium are present in substantially more than trace amounts in the alloys used in the present invention, for example up to the 0.5 wt % maximum preferred impurity level of Table I, then higher overaging temperatures, longer overaging times, with or without higher cold work of up to about 80%, may be necessary to achieve sufficiently low strength by overaging. See, for instance, Alloy B, Examples 18-B and 19-B compared to Alloy A, Examples 2-A through 8-A and 13-A to 15-A.

Although only a few embodiments of the present invention have been described above, many modifications can be made without departing from the spirit and scope of the invention. For example, although FIGS. 1 and 2 illustrate only one geometry for the inventive connector, it should be appreciated that any other geometry can be employed. So long as the connector has a crimp section designed to securely join a wire or other component through crimping and a spring section designed to securely join a mating connector by spring force exerted by the connector, the connector design is appropriate for the present invention. All such modifications are intended to be included within the scope of the present invention, which is to be limited only by the following claims:

I claim:

1. An electrical device having a spring section capable of maintaining a desired spring normal force after repeated matings and a crimp section capable of being joined to a wire or other component by crack-free crimping without localized annealing of the crimp section before crimping, the device being formed from an alloy comprising 0.15 to 0.5 wt. % Be, 0.4 to 1.40 wt. % Ni or Co or both, 0.2 to 1.0 wt. % Pb, up to 0.50 wt. % Zn, the balance being copper and incidental impurities, wherein the device after final solution annealing is cold worked by 40 to 80% and is overaged during age-hardening so that the alloy forming the device achieves a final 0.2% yield strength between about 60 and 80 ksi.

2. The device of claim 1, wherein the alloy forming the device has a ductility between about 20 and 65%, measured in terms of area reduction.

3. The device of claim 2, wherein the alloy forming the device has a ductility between about 30 and 65%, measured in terms of area reduction.

4. The electrical connector of claim 1, wherein the alloy forming the device is overaged to less than 95% of its maximum peak aged tensile strength.

5. The electrical connector of claim 1, wherein the alloy forming the device is overaged to less than 90% of its maximum peak aged tensile strength.

6. An electrical device having a spring section capable of maintaining a desired spring normal force after repeated matings and a crimp section capable of being joined to a wire or other component by crack-free crimping without localized annealing of the crimp section before crimping, the device being formed from an alloy comprising 0.20 to 0.40 wt. % Be, 0.50 to 1.25 wt. % Ni or Co or both, 0.20 to 0.60 wt. % Pb, up to 0.50 wt. % total of one or more of Fe, Al, Si, Cr, Sn, Zn, Ag, Mn, Zr, Ti and Mg, and other incidental impurities, the balance being copper, wherein the device after final solution annealing is cold worked by 40 to 80% and is overaged during age-hardening so that the alloy forming the device achieves a final 0.2% yield strength between about 60 and 80 ksi.

7. The electrical connector of claim 6, wherein the alloy contains 0.25 to 0.50 wt. % Pb.

8. The electrical connector of claim 1, wherein the electrical connector is formed from extruded wire or bar.

9. The electrical connector of claim 8, wherein the crimp section of the electrical connector comprises a hollow cylindrical section formed by cold heading and/or machining.

10. A room temperature crimpable electrical connector having a spring section capable of maintaining a desired spring normal force after repeated matings and a crimp section capable of being joined to a wire or other component by crack-free crimping without localized annealing of the crimp section before crimping, the electrical connector being formed by:

(a) extruding, optionally intermediate annealing, and cold drawing a Be-Cu alloy comprising 0.15 to 0.50 wt. % Be, 0.40 to 1.40 wt. % Ni or Co or both, 0.20 to 1.0 wt. % Pb, up to 0.50 wt. % total of one or more of Fe, Al, Si, Cr, Sn, Zn, Ag, Mn, Zr, Ti and Mg, the balance being copper and incidental impurities, into a wire having a ready to finish diameter, (b) final solution annealing the wire, (c) cold working the wire by about 40 to 80% in terms of area reduction, and (d) age hardening the wire by overaging the wire such that the 0.2 yield strength of the alloy forming the wire is between about 60 and 80 ksi and the ultimate tensile strength of the alloy forming the wire is less than 95% of the maximum ultimate tensile strength of the alloy when peak aged.

11. The electrical connector of claim 10, wherein the wire is severed into sections and further wherein a hollow cylindrical section is formed by cold heading in at least one end of the sections after final solution annealing and before age hardening is completed.

12. The electrical connector of claim 11, wherein the alloy contains 0.20 to 0.60 wt. % Pb.

13. The electrical connector of claim 8, wherein the electrical connector is made from a single piece of extruded rod or bar.

* * * * *